US008083072B2

(12) United States Patent
Botton et al.

(10) Patent No.: US 8,083,072 B2
(45) Date of Patent: Dec. 27, 2011

(54) MOBILE VIBRATING SCREEN WITH FLEXIBLE SHAFT

(75) Inventors: Albert Botton, Marion, IA (US); Edwin J. Sauser, Monticello, IA (US)

(73) Assignee: Terex USA, LLC, Wilmington, DE (US)

( * ) Notice: Subject to any disclaimer, the term of this patent is extended or adjusted under 35 U.S.C. 154(b) by 168 days.

(21) Appl. No.: 12/482,643

(22) Filed: Jun. 11, 2009

(65) Prior Publication Data

US 2010/0314299 A1 Dec. 16, 2010

(51) Int. Cl.
*B07B 1/42* (2006.01)

(52) U.S. Cl. ..... 209/365.2; 209/366.5; 209/367; 209/413; 209/421

(58) Field of Classification Search ..... 209/364, 209/366, 366.5, 367, 413, 414, 420, 421, 209/365.2
See application file for complete search history.

(56) References Cited

U.S. PATENT DOCUMENTS

| | | | | |
|---|---|---|---|---|
| 3,439,806 | A * | 4/1969 | Kass et al. | 209/260 |
| 3,976,142 | A * | 8/1976 | Plasser et al. | 171/16 |
| RE34,289 | E * | 6/1993 | McClain et al. | 209/421 |
| 6,405,952 | B1 * | 6/2002 | Zoz | 241/172 |
| 2003/0019799 | A1 * | 1/2003 | Masukane et al. | 209/691 |

* cited by examiner

*Primary Examiner* — Joseph C Rodriguez
(74) *Attorney, Agent, or Firm* — Simmons Perrine Moyer Bergman PLC

(57) ABSTRACT

A mobile vibrating screen with a readily stowable and pivoting drive system comprising a motor with an attached drive sheave, a belt, a driven sheave and plurality of universal joints which are configured to maintain a connection between the motor and an eccentric weight shaft when said drive system is switched from an operational configuration to a stowed configuration. In an alternate embodiment, some small d parts, e.g. drive shaft, need to be removed and stowed elsewhere on the plant when drive is converted from operation to transport.

20 Claims, 7 Drawing Sheets

MOBILE VIBRATING SCREEN WITH FLEXIBLE SHAFT

FIELD OF THE INVENTION

The present invention generally relates to vibrating screens used in mining or road building material handling and processing.

BACKGROUND OF THE INVENTION

In the past, vibrating screen machines are normally made of a box-like structure mounted on flexible springs and contain one or multiple layers of screen mesh to sort granular materials. The different sized openings in the mesh allow sizing of materials according to the size of these openings. The box structure usually contains an eccentric weighted shaft that shakes the box and its screen mesh to agitate and separate the granular materials fed into the top of the machine. The speed at which the eccentric shaft spins is dependent on the type of screen process. Usually a higher speed is desired when sorting smaller granular materials, while slower speeds are desired for sorting coarse materials. A v-belt drive is commonly used to convert the speed of the driving motor to the desired speed of the screen shaft. Since the machine shakes from action of the eccentric weighted shaft, a flexible means of transferring power to the shaft is required to transfer power from the stationary driving motor which is necessarily located outside of the box like structure. Normally, this is accomplished using v-belts from the pulley of the motor to a pulley on the screen shaft. Either the motor is mounted on a pivoting base that allows the motor shaft to move with the screen shaft to maintain tension, or a belt tensioning idler is used to maintain belt tension between the driven pulley and the drive pulley. Many of these systems have performed well in the past. However, the pivot base method and tensioning idler method are both susceptible to belt slip and belt jump, especially when the screen is surging during startup and shutdown. Both of these also perform poorly if there is an attempt to decelerate the screen with the motor or a brake on the motor.

Also, the drive belts and motor are normally required to be removed to allow repositioning of the motor to minimize travel dimensions of the screen machine.

Consequently, there exists a need for a vibrating screen which allows the connection between the motor and the eccentric weighted shaft to remain in place during operation, transporting the screen and the process of converting from operational mode to transport mode.

SUMMARY OF THE INVENTION

It is an object of the present invention to provide a mobile vibrating screen which can be efficiently repositioned into a transport position to minimize travel dimensions.

It is a feature of the present invention to utilize flexible joints and a telescoping shaft.

It is an advantage of the present invention to provide for the ability of a transport reconfiguration without need to remove motor and v-belts or otherwise disassemble the drive.

The present invention is an apparatus and method for screening material which is designed to satisfy the aforementioned needs, provide the previously stated objects, include the above-listed features, and achieve the already articulated advantages. For some screening operations, the present invention is carried out in a "belt-slip-less system" in a sense that the belt slip associated with relative movement between the motor and the main large driven sheave caused by vibration of the screen during operation has been greatly reduced.

Accordingly, the present invention is a system and method for driving the vibration of a vibrating screen plant and easily converting into a transport mode with reduced dimensions to facilitate travel on the public roadways.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
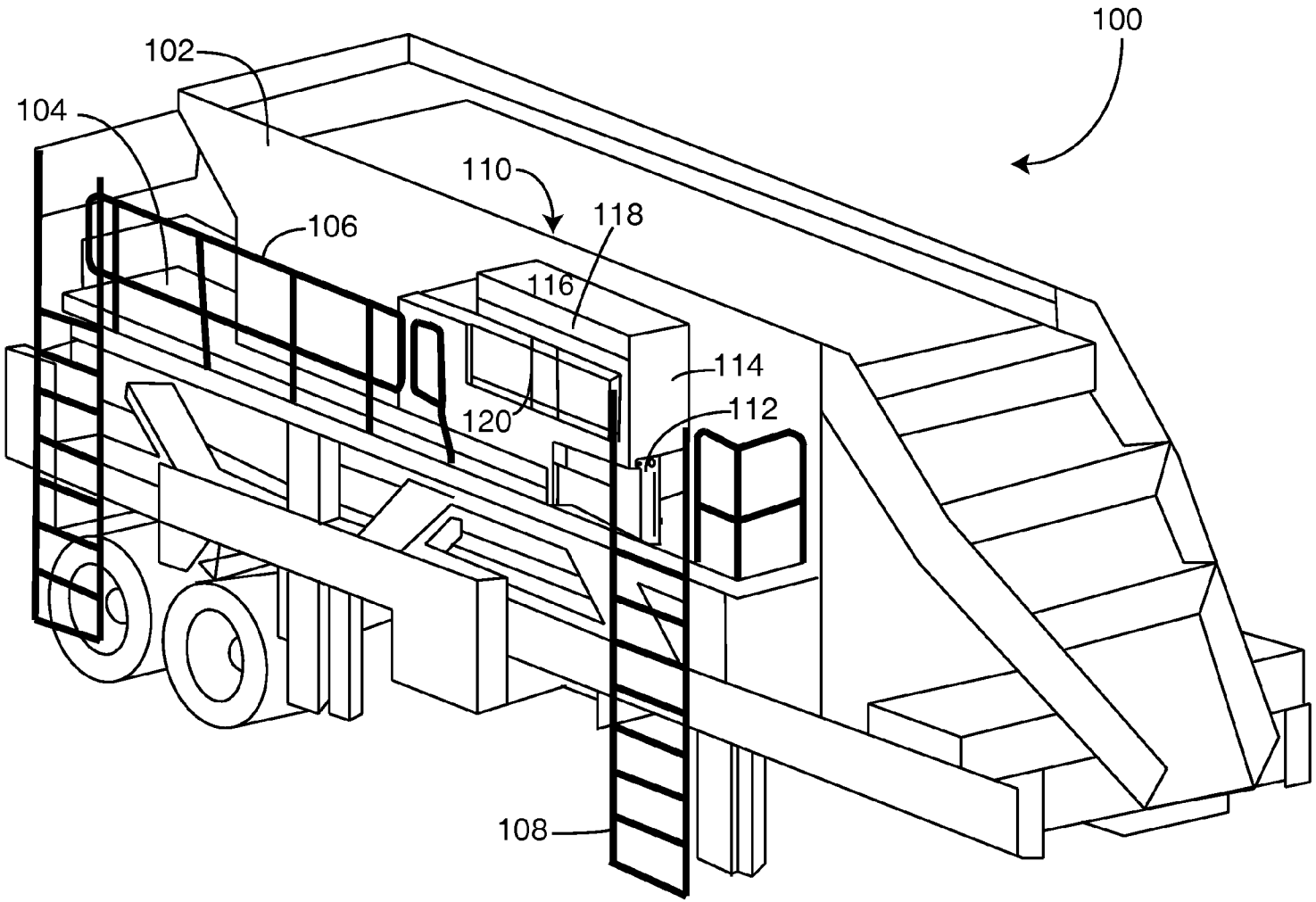
FIG. 1 is a perspective view of the vibrating screen of the present invention, shown in a transport configuration.

Now referring to the drawings wherein like numerals refer to like matter throughout, and more particularly to FIG. 1, there is shown a vibrating screen system 100 of the present invention. Vibrating screen system 100 is a mobile system which is sized and configured to be pulled by a semi-tractor. As with most prior art mobile screens, there is a main vibrating screen assembly 102 disposed atop a deck 104 which is bounded by a safety hand railing 106 and includes a heavy unbalanced shaft or wheel, which when rotated causes the system to vibrate; other methods of inducing vibration could be substituted as well. Main vibrating screen assembly 102 can be one or more screens for sorting or discriminating matter fed into the vibrating screen system 100. The vibration drive system 110 of the present invention is generally shown in the transport configuration where it is stowed away to reduce the overall maximum dimensions of the vibrating screen system 100. Vibration drive system 110 is pivotally mounted on vibration drive system stationary pivot pin support 112. Also shown is first side housing 114, drive belt cover plate 116, vibration drive system mounting plate 118 and pivoting support structure 120, in stowed configuration for transport. Vibrating screen system 100 is shown having a ladder 108.

Figure 2:
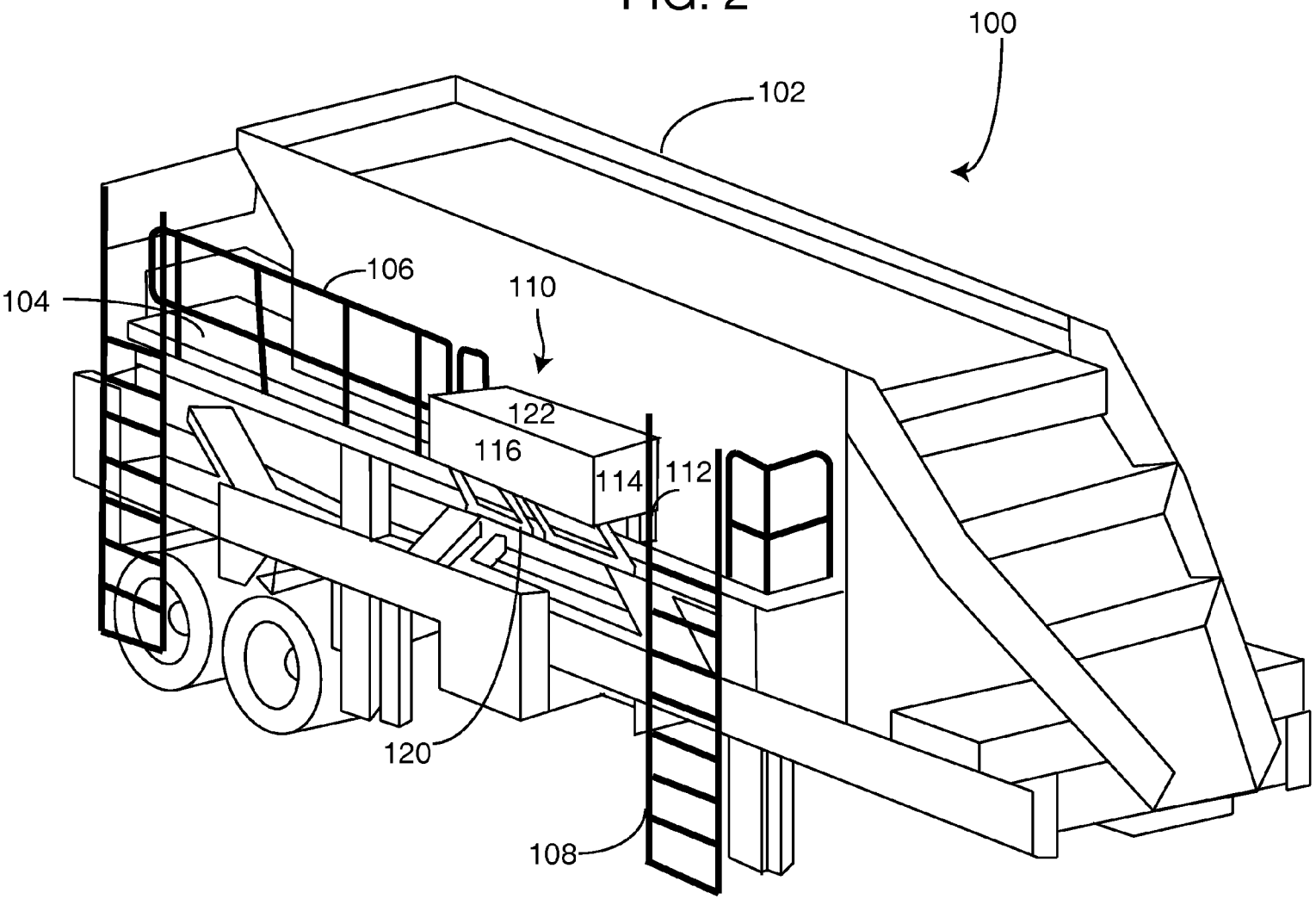
FIG. 2 is a perspective view of the vibrating screen of FIG. 1, shown in an operating configuration.

Now referring to FIG. 2, there is shown the vibrating screen system 100 of FIG. 1 except that the vibration drive system 110 is now downwardly deployed into an operating configuration. The drive assembly hinged cover 122 is now exposed, and the pivoting support structure 120 has been pivoted down to provide support for the now protruding vibration drive system 110.

Figure 3:
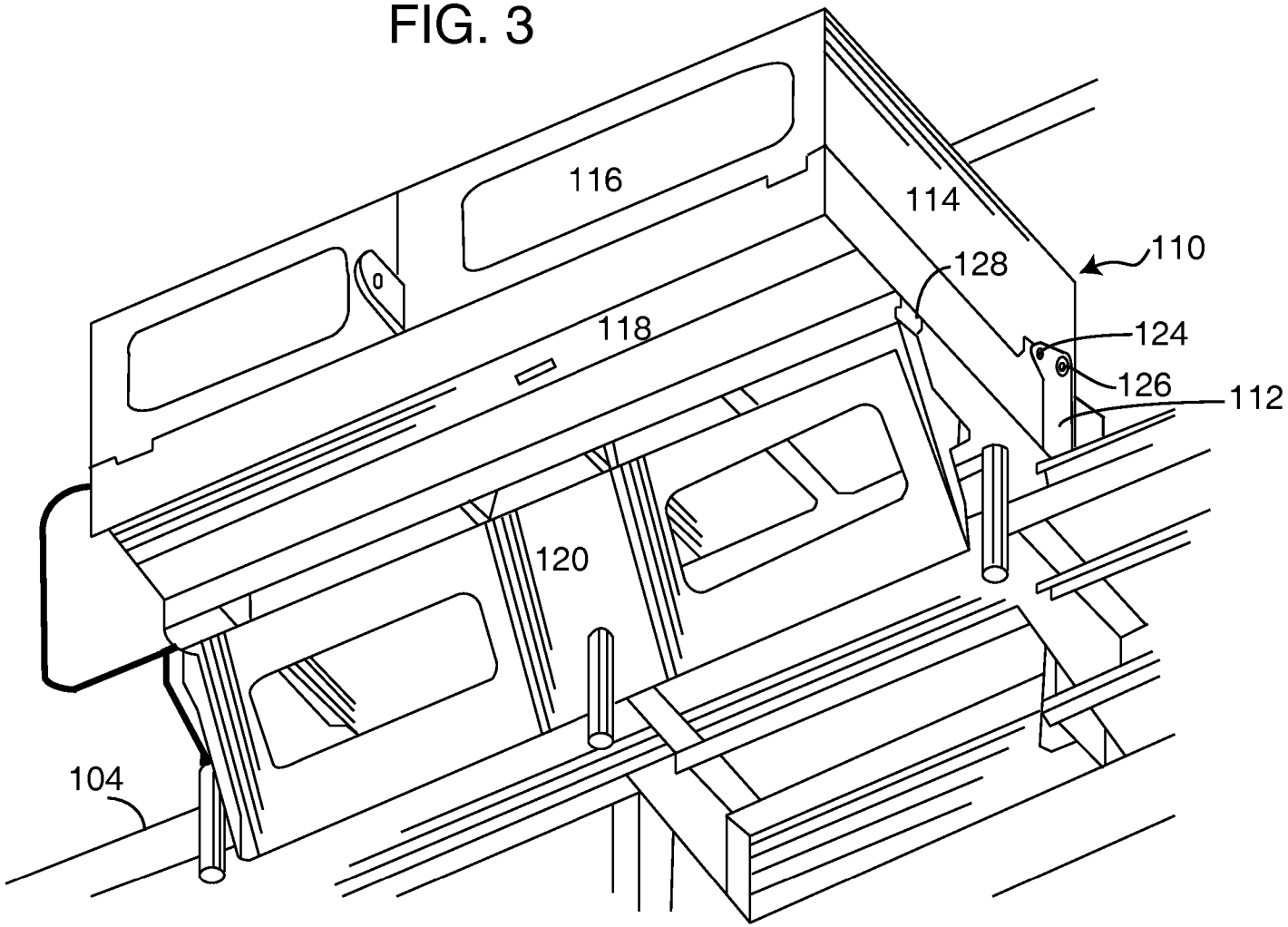
FIG. 3 is a perspective view looking upward at an underside of a pivoting vibration drive portion of the vibrating screen of FIG. 2.

Now referring to FIG. 3, there is shown an upward looking view at an underside of the vibration drive system 110 of FIG. 2 where the pivoting support structure 120 is deployed. Also shown is vibration drive system mounting plate 118. The pivoting support structure 120 pivots about pivoting support structure pivot point 128, and the entire vibration drive system 110 pivots about stationary support inside pin 124. Also shown is stationary support distal pin 126.

Figure 4:
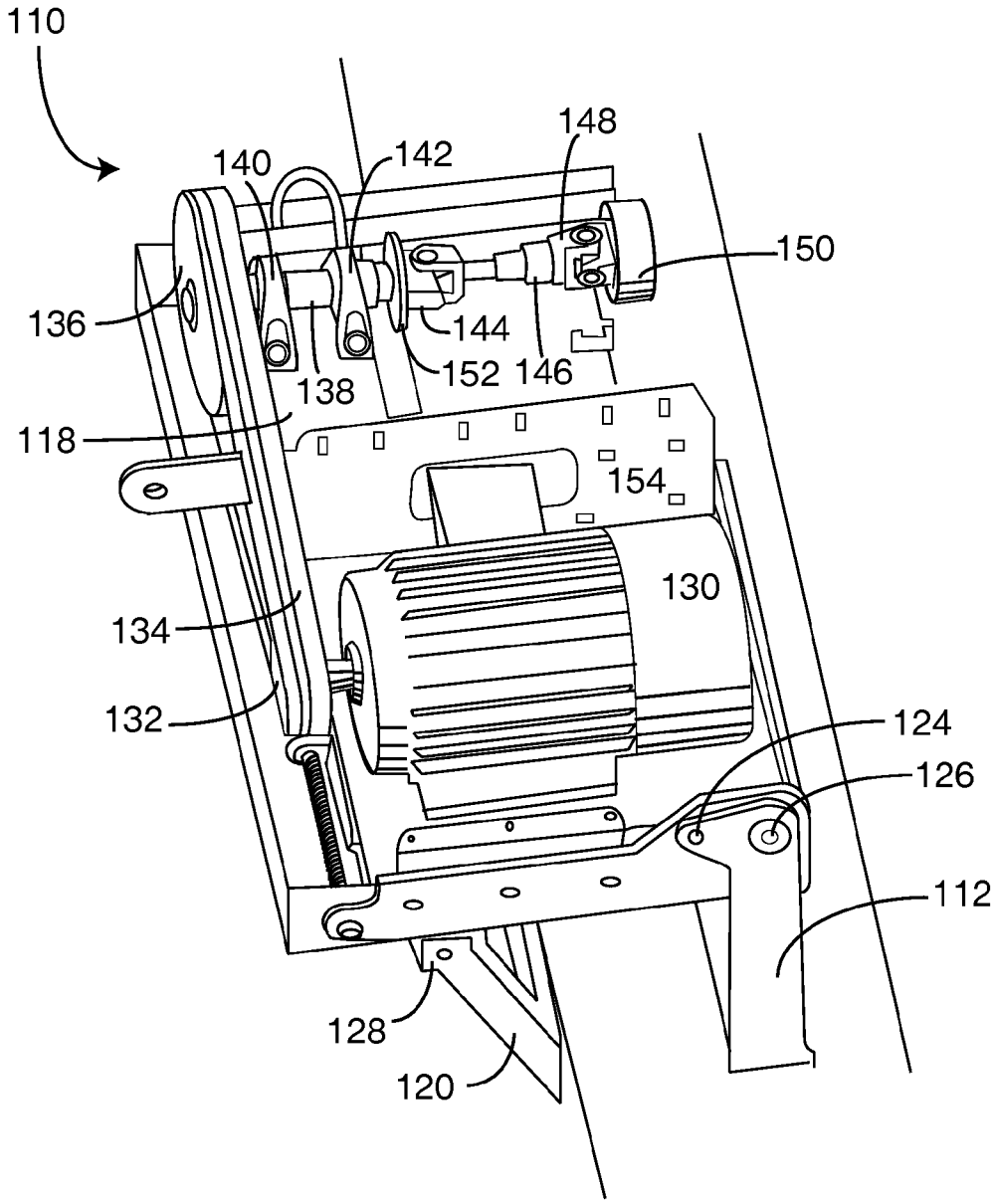
FIG. 4 is a close-up view of the vibration drive system of FIGS. 1-3 shown in an operating configuration with exterior shielding removed to reveal the operational components.

Now referring to FIG. 4, there is shown a perspective view of the inner workings of vibration drive system 110 after first side housing 114, drive belt cover plate 116 drive assembly hinged cover 122 and other covers have been removed.

Vibration drive system motor 130 is a motor which may be electrical or a suitable substitute which is coupled to a vibration drive system motor sheave 132 which receives therein vibration drive system drive belt 134, which is coupled to vibration drive system main large sheave 136, which is coupled to positionally fixed drive shaft 138, which is fixed at a location on vibration drive system mounting plate 118 by positionally fixed drive shaft mounting bracket or mounted bearing 142 and positionally fixed drive shaft mounting bracket or mounted bearing 140. With the vibration drive system motor 130 and the vibration drive system main large sheave 136 being mounted in a fixed relative position relationship, the belt slip of some prior art systems is reduced. Positionally fixed drive shaft mounting bracket 140 and positionally fixed drive shaft mounting bracket 142 help to fix drive shaft 138 laterally and longitudinally while still allowing rotational forces to impact first universal joint 144 and telescopic drive shaft 146 and second universal joint 148. Telescopic drive shaft 146 is configured to provide for a variable separation between brake disk 152 and wheel coupler 150 both during the process of converting from operation to transport configuration and during the vibrations occurring during operation. The brake disk 152 could be a mechanical brake, an engine brake or power reversal or other means, or it could be omitted. The drive system could be made to remain connected as described or in an alternate embodiment (see FIG. 7), it could be partially disassembled.

Figure 5:
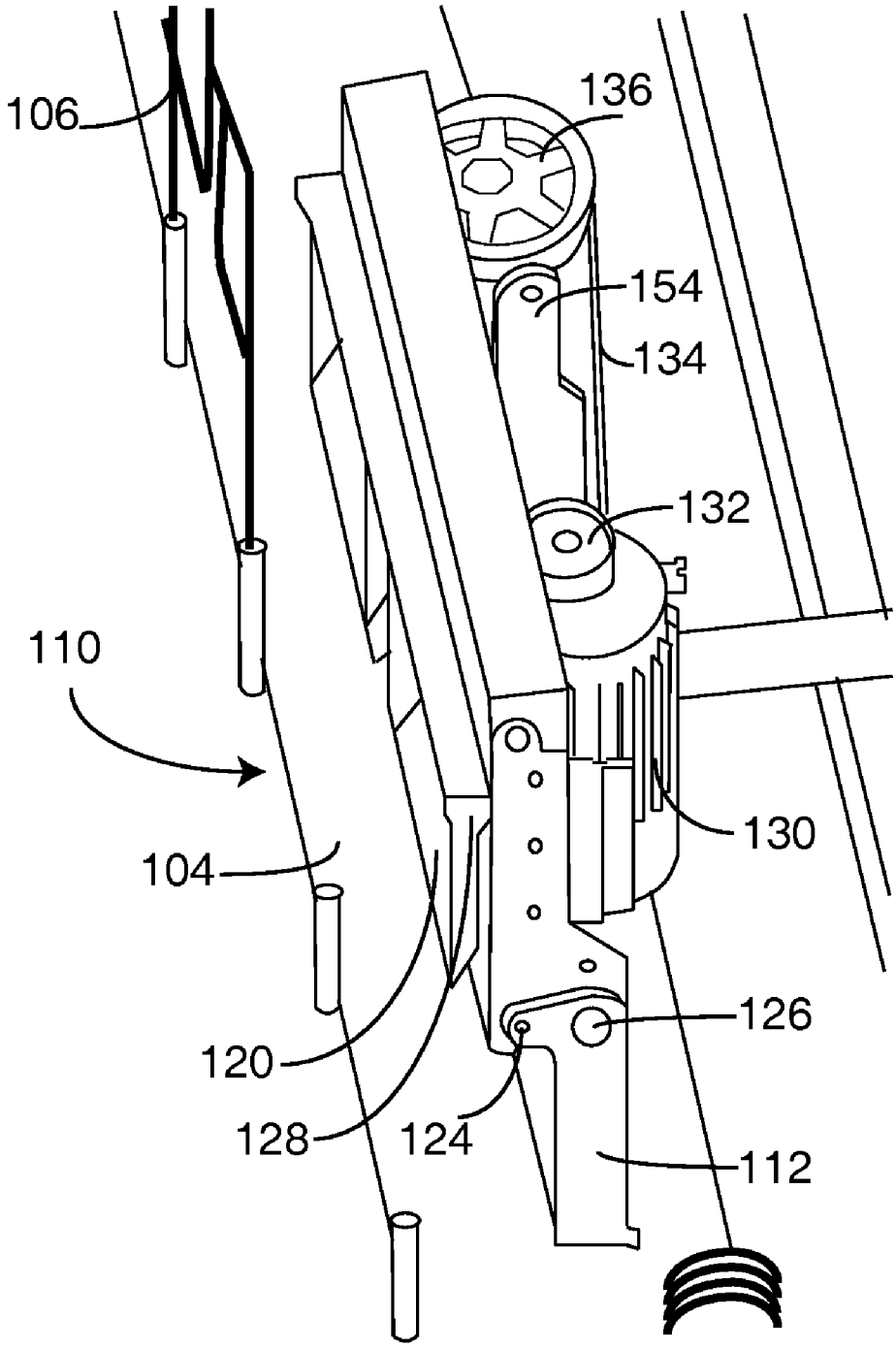
FIG. 5 is a close-up view of the vibration drive system of FIGS. 1-4 shown in a transport configuration with exterior shielding removed to reveal the operational components.

Now referring to FIG. 5, there is shown the vibration drive system 110 of FIG. 4 stowed in the transport configuration, which is accomplished without removing any parts. This is enabled by first universal joint 144, and telescopic drive shaft 146 and second universal joint 148, together which cooperate to permit easy stowing and thereby easily reducing the width of the system and facilitates transport on width limited public roadways. These items 144, 146, and 148 (FIG. 4) allow for a stowable drive system without the belt slippage that is common in prior art systems where a belt spans from the movable pivoting motor and drive structure to the frame of the entire system. Not having this belt and requisite idler provides for many of the benefits of the present invention.

Figure 6:
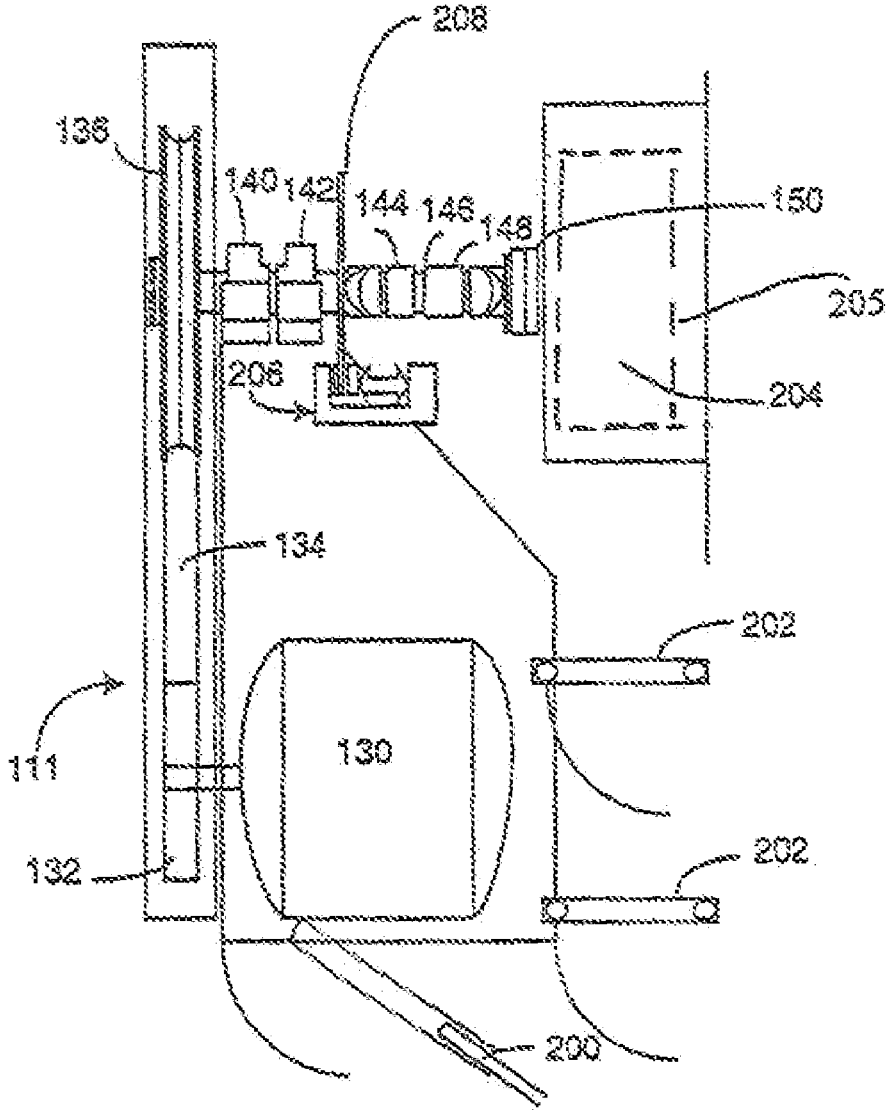
FIG. 6 is a schematic diagram of an embodiment of the present invention.

Now referring to FIG. 6, there is shown an embodiment of the present invention generally showing a vibration drive system 111 which is similar to vibration drive system 110 in many respects. Also shown is telescopic support crank jack 200 and swing-down motor supports 202. A disc brake disc 208 is shown coupled between positionally fixed drive shaft mounting bracket 142 and telescopic drive shaft 146. This disc brake disc 208 is configured to mate with disc brake caliper 206 and provide for a faster shutdown procedure if desired. Also shown is screen wheel case 204 which houses the eccentric weighted shaft that shakes the screen as is well known in prior art mobile vibrating screens.

Figure 7:
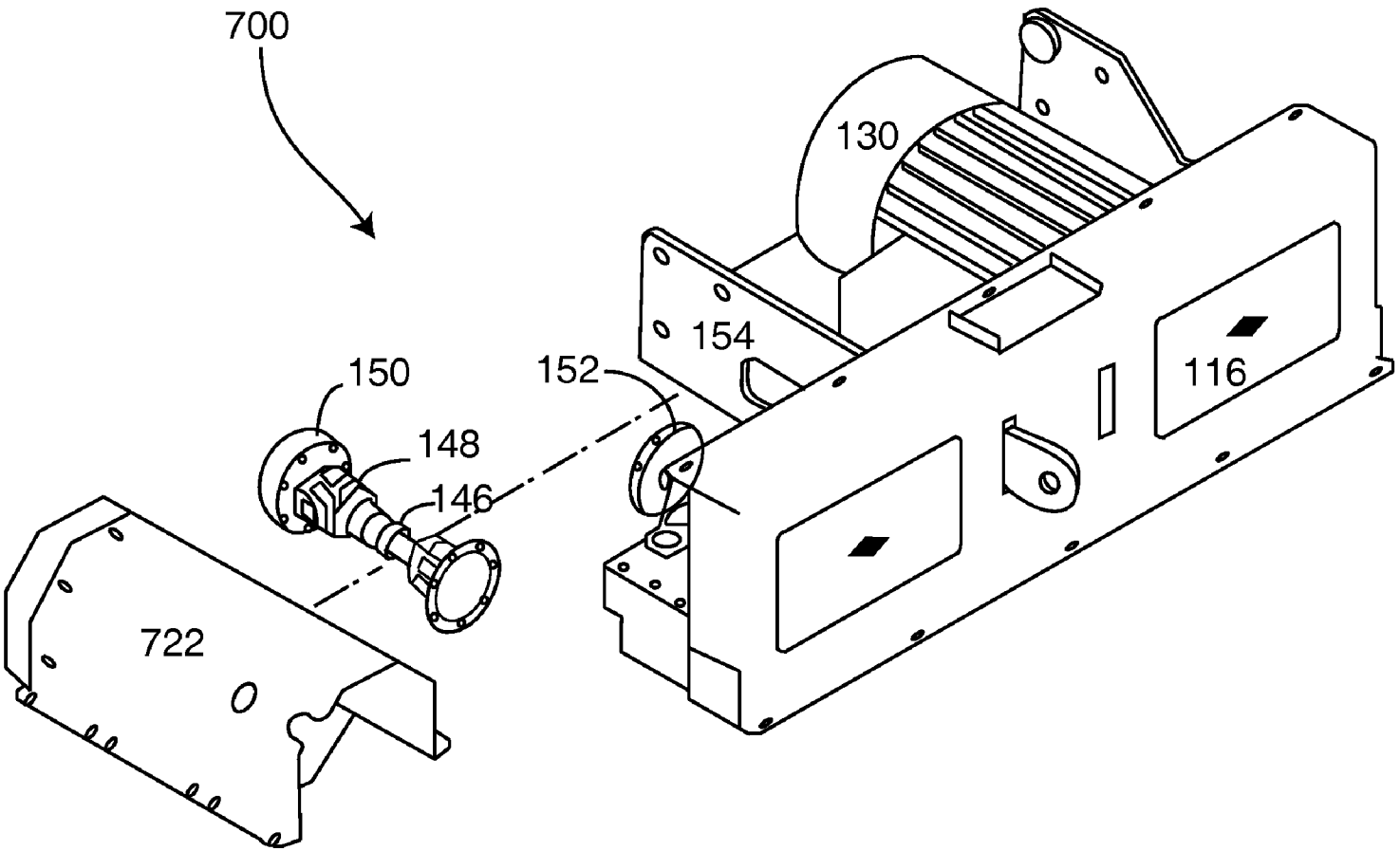
FIG. 7 is a perspective view of an alternate embodiment of the present invention.

Now referring to FIG. 7, there is shown an alternate embodiment of the present invention where the following components of the drive assembly are detached and removed for transportation: wheel coupler 150, second universal joint 148, telescopic drive shaft 146, and first universal joint 144. This system can fold up and down on stationary support distal pin 124, just as elsewhere described. First universal joint 144, telescopic drive shaft 146 and second universal joint 148 could be used just as shown; however, these "flexible" components could be replaced with non or less-flexible components as it would no longer be needed to accommodate the requirement for folding, which is eliminated by the removal of such non-flexible items.

The present invention is described with belts and sheaves, but it should be understood that the power transmission could be accomplished with chains and sprockets, gears or other suitable substitutes. The term "positionally fixed" is used herein to refer to something that has a location or position that is fixed, but still permits rotational motion. The term "universal joint" is used herein to refer to a special coupler which provides for multiple degrees of freedom while maintaining a rotational connection.

The present invention is described as an apparatus, but it should be understood that it could be a method as well, such as:

a method of deploying a mobile vibrating screen material discriminator comprising the steps of:

providing a frame;

providing a screen, coupled to said frame, said screen having a predetermined opening size characteristic for discriminating a predetermined size of material from other larger material;

transferring energy of rotation into vibration of the screen;

providing a motor for generating rotational energy;

deploying a drive system from an operational configuration to a transport configuration, such that when said drive system is converted from said operational configuration where rotation energy is transferred from the motor to a means for transferring energy of rotation into vibration of the screen; to the transport configuration, there is no disconnection of said drive system from one of said motor and said means for transferring, there is no belt removal, and there is no moving closer together of sheaves coupled together by a first drive belt.

It is thought that the method and apparatus of the present invention will be understood from the foregoing description and that it will be apparent that various changes may be made in the form, construct steps, and arrangement of the parts and steps thereof, without departing from the spirit and scope of the invention or sacrificing all of their material advantages. This includes using an external thread on the lower assembly 100 and an internal thread on the upper assembly. The form herein described is merely a preferred exemplary embodiment thereof.

We claim:

1. A mobile system for screening material comprising:

an elongated structure configured to be rolled over the surface of a public roadway;

a vibrating screen assembly coupled to and supported by said elongated structure;

a means for receiving rotary power and causing said vibration screen assembly to vibrate;

a source of rotary power disposed outside of said vibrating screen assembly and configured so as to be pivoted between operational and transport modes, where the transport mode provides a reduction in a maximum dimension of a combination of said vibrating screen assembly and said source of rotary power;

said source of rotary power being free from a closed loop elongated flexible member which couples and provides power transmission from a first circular member and a second circular member which are configured to receive said closed loop elongated flexible member, such that a separation distance between centers of said first circular member and said second circular member vary during one of operation of the vibrating screen and conversion from said operational mode and said transport mode.

2. The mobile vibrating screen of claim 1 wherein said source of rotary power further being free of any idler sheave disposed between said first circular member and said second circular member for maintaining tension in said closed loop elongated flexible member as slack occurs therein resulting from relative displacement between said first circular member and said second circular member.

3. The mobile vibrating screen of claim 1 wherein said source of rotary power comprises a motor mounted on a base which is movably coupled with an exterior of said vibrating screen assembly and said means for receiving rotary power and causing said vibration screen assembly to vibrate comprise an eccentric weighted rotating member.

4. The mobile vibrating screen of claim 3 wherein said first circular member is a first sheave, and the second circular member is a second sheave which is larger in diameter than said first sheave, and said second sheave is coupled to said motor via a belt.

5. The mobile vibrating screen of claim 4 wherein said second sheave is coupled to said eccentric weighted member by a first universal joint and a second universal joint.

6. The mobile vibrating screen of claim 5 wherein said first universal joint is directly coupled to said second sheave, and said second universal joint is directly coupled to said eccentric weighted member.

7. The mobile vibrating screen of claim 5 further comprising a telescopic shaft disposed between the second sheave and the eccentric weighted member.

8. The mobile vibrating screen of claim 7 wherein said telescopic shaft is directly coupled between said first universal joint and said second universal joint.

9. A mobile vibrating screen comprising:

a base for providing structural support;

said base being mobile and supported by wheels and further structured and configured for travelling on a public roadway;

a motor for providing rotational energy coupled pivotally with the base;

a screen coupled to said base and configured to discriminate material when vibrated;

an eccentric weighted shaft which is positionally fixedly coupled to said base while allowing rotation of the eccentric weighted shaft so that rotation causes the screen to vibrate;

a flexible drive shaft disposed between and rotationally coupling said motor with said eccentric weighted shaft which comprises:

a first universal joint;

a second universal joint; and a telescopic shaft disposed between said first universal joint and said second universal joint.

10. The mobile vibrating screen of claim 9 further comprising a first sheave and a second sheave wherein said flexible shaft is coupled to said second sheave, and said first sheave is directly coupled to said motor and coupled via a belt to said second sheave.

11. The mobile vibrating screen of claim 9 wherein centers of said first sheave and said second sheave are positionally fixed relative to each other.

12. The mobile vibrating screen of claim 11 wherein said motor can be pivoted with respect to said eccentric weighted shaft while continuously maintaining a rotational connection with a belt, without a need to make any changes which tend to affect any coupling of the belt with one of said first sheave and said second sheave.

13. The mobile vibrating screen of claim 12 further comprising a pivoting support structure supporting said motor when said motor is pivoted from a stowed transport position to an operational deployed position.

14. A mobile vibrating screen material discriminator comprising:

a frame;

a screen, coupled to said frame, said screen having a predetermined opening size characteristic for discriminating a predetermined size of material from other larger material;

means for transferring energy of rotation into vibration of the screen;

a motor for generating rotational energy;

means for deploying a drive system from an operational configuration to a transport configuration, such that when said drive system is converted from said operational configuration where rotation energy is transferred from the motor to said means for transferring; to the transport configuration, there is a reduction in a width characteristic of said drive system, so as to facilitate transportation on a public roadway, and further there is no need to disconnect said drive system from one of said motor and said means for transferring.

15. A mobile vibrating screen material discriminator comprising:

a frame;

a screen, coupled to said frame, said screen having a predetermined opening size characteristic for discriminating a predetermined size of material from other larger material;

means for transferring energy of rotation into vibration of the screen;

a motor for generating rotational energy;

means for deploying a drive system from an operational configuration to a transport configuration, such that when said drive system is converted from said operational configuration where rotation energy is transferred from the motor to said means for transferring; to the transport configuration, there is no need to disconnect said drive system from one of said motor and said means for transferring;

wherein said means for deploying comprises a pivoting motor base which is configured to support said motor when in an operational configuration and when in a transport configuration.

16. The mobile vibrating screen of claim 15 wherein said means for deploying further comprises a drive sheave coupled to said motor and a driven sheave disposed at a fixed location with respect to said drive sheave; and further comprising a plurality of universal joints disposed between said driven sheave and said means for transferring.

17. The mobile vibrating screen of claim 16 further comprising a telescopic shaft disposed between and coupling two of said plurality of universal joints.

18. The mobile vibrating screen of claim 17 further comprising a disc brake disc disposed between said driven sheave and said telescopic shaft.

19. The mobile vibrating screen of claim 18 further comprising a means for limiting driven sheave positional displacement forces from moving said driven sheave with respect to said drive sheave.

20. The mobile vibration screen of claim 19 wherein said means for limiting comprises a series of positionally fixed drive shaft mounting bearing disposed between the driven sheave and the telescopic shaft.

* * * * *